US008794157B2

(12) United States Patent
Aguirre Fernandez

(10) Patent No.: US 8,794,157 B2
(45) Date of Patent: Aug. 5, 2014

(54) AUTOMATIC MACHINE FOR LEVELING AND ALIGNMENT OF RAILWAY IN PLATE, PRIOR TO THE CONCRETE

(75) Inventor: José Mª Aguirre Fernandez, Madrid (ES)

(73) Assignee: Tecsa Empresa Constructora, S.A., Madrid (ES)

( * ) Notice: Subject to any disclaimer, the term of this patent is extended or adjusted under 35 U.S.C. 154(b) by 264 days.

(21) Appl. No.: 13/427,122

(22) Filed: Mar. 22, 2012

(65) Prior Publication Data

US 2012/0240809 A1 Sep. 27, 2012

(30) Foreign Application Priority Data

Mar. 24, 2011 (ES) ..... 201130426

(51) Int. Cl.
*E01B 33/00* (2006.01)
*E01B 33/02* (2006.01)

(52) U.S. Cl.
USPC ..... 104/7.2; 104/4

(58) Field of Classification Search
USPC ..... 104/2–9; 246/167 R, 186, 187 B
See application file for complete search history.

(56) References Cited

U.S. PATENT DOCUMENTS

| | | | | | |
|---|---|---|---|---|---|
| 4,724,653 | A | * | 2/1988 | Buhler | 33/228 |
| 5,157,840 | A | * | 10/1992 | Henttinen | 33/287 |
| 5,671,679 | A | * | 9/1997 | Straub et al. | 104/2 |
| 6,260,485 | B1 | * | 7/2001 | Theurer et al. | 104/7.2 |

FOREIGN PATENT DOCUMENTS

| | | | |
|---|---|---|---|
| CN | 201187021 | Y | 1/2009 |
| CN | 101701440 | A | 5/2010 |
| CN | 101705650 | A | 5/2010 |
| DE | 19733633 | C1 | 10/1998 |
| EP | 1103657 | A2 | 5/2001 |
| GB | 2312703 | A | 11/1997 |
| WO | 9950502 | A1 | 10/1999 |

* cited by examiner

*Primary Examiner* — R. J. McCarry, Jr.
(74) *Attorney, Agent, or Firm* — Brown & Michaels, PC

(57) ABSTRACT

Automatic machine for leveling and alignment of ballastless railway, prior to concreting, having a structure (1) that moves along the track, provided with fastening elements to, once located in the track section to be positioned, firmly grab both rails (10) keeping the track in suspension while it performs millimetric movements of displacement until placing it in the desired final position, both in plant and height of the rails and cant; said machine has a measuring system, which includes tilt sensors (11) and a total station (12) of GPS or topographic type, that allow to identify the actual position of the track, in real-time. It also has a control system that includes process software of the position data acquired by the measuring devices (11-12), from which it determines the required movements to be carried out to achieve the desired final position of the track.

11 Claims, 6 Drawing Sheets

AUTOMATIC MACHINE FOR LEVELING AND ALIGNMENT OF RAILWAY IN PLATE, PRIOR TO THE CONCRETE

BACKGROUND OF THE INVENTION

The leveling and alignment process of the ballastless track today is a manual, very little automated process, which is carried out by making successive approximations, and that requires successive topographical checks by measurement equipment and external topography staff, who should be measuring and transmitting the position that the rails will be acquiring during the process so that this can be corrected through the usual procedure using jacks, aligner or leveler spindles, until finally reaching the definitive position.

That is, starting with a first approximation lift, and after the corresponding external topographic checking of the achieved position, the information obtained from the measurement carried out must be transmitted by topography staff to the staff in charge of the physical positioning of the track, point at which the position can be manually corrected and checked again, and so forth until it is verified that the position of the track is within the required tolerances, point at which, after firmly fixing the position, it can be concreted.

The position of the rails is usually measured using a topographic station and a prism supported by an operator on the active side of the rail—being able to use in addition a cant straightedge—, or through the use of a track auscultator cart, or using a mixed topographic system between both options.

An alternative to this process, which is also commonly used, consists of the previous marking in fixed references of the final position at every certain length of track. In this case, the topographic work is carried out in advance, and the approach to the final position marked on each section of track is done by reference to those previously marked data making successive manual checks.

These methods, as well as other existing methods, all of them manual and no automated, imply that the current process is extremely slow and has a high cost.

DESCRIPTION OF THE INVENTION

The invention, as its title suggests, relates to a machine intended for automatically and accurately leveling and aligning a ballastless railway prior to its concreting.

Starting from the initial position of the rails—or the assembly formed by the rails already fixed to the sleepers in what is called "pre-assembled track" or "skeleton track"—previously lying on a prior base—flooring of the future ballastless track—, the machine is able to hold them and displace them with the movements needed to achieve from that starting position the desired final position, once accurately positioned being fixed by lifting means in that suspended position, being able to then proceed to concrete the assembly on the prior base on which it has been settled, the concrete slab formed constituting the support mean which replaces the ballast of a traditional track.

A ballastless railroad track is formed, in a generic way, by two rails joined through fasteners to connecting elements such as sleepers, individual blocks, frames or simply direct fasteners in its lower part, and there are multiple typologies. In a ballastless track the rails and the sleepers/blocks/direct fasteners are placed, and once this assembly has been properly positioned with the strict required tolerances, it is fixed in its final position and it is concreted to achieve the so-called concreted track. The position of the track is defined by a path and a section. The path is defined by an altimetry and a planimetry. With regard to the cross section, it is defined by a cant in each position, as well as a series of constraints: the heads of the two rails form a running surface, the distance between the two rails must be fixed and symmetrical with respect to the central axis of the track, and its vertical axis must normally have an inclination with respect to the vertical axis perpendicular to the running surface defined. The tolerances of these parameters are, in general, very strict, and all of this makes it a geometrically complex system.

Starting from the skeleton track—i.e., once the rails are settled and fixed on the sleepers/blocks/fasteners, these in turn settled on the prior base or flooring-, the "ballastless track" construction requires the use of leveling and alignment means that carry out the displacements needed to establish the exact position of the rails-fasteners assembly, point at which, after the definitive fixation of the assembly in that exact final position reached through the lifting means, the concrete of the assembly on the prior base is carried out, the concrete slab formed forming the support means of the rails, replacing the traditional track ballast. There are required processes of leveling, alignment and fixation of the track in its position of a high accuracy, so this activity is essential in the process of construction of such railway tracks.

The object of the present invention is a machine capable of leveling and aligning the track through a hydraulic system until leaving it at its exact position, completely automatically and without human intervention, in a single step, so that at that moment the track can be fixed and then proceed to the concreting.

The machine is formed by a mobile metallic structure consisting of several bodies, its own hydraulic and electrical system and an track control and measurement system enabling its movements and displacement, so that, once positioned on the rails in a given section of the preassembled track—skeleton—to be positioned, it is able to firmly fasten both rails of the track by fastening elements, and to move it to its final position: lifting each of the rails up to the necessary height and displacing them sideways, until reaching the definitive position, all of it automatically.

To enable the automatic movement a control system, software and a measuring system itself have been developed and included. Through the measuring system itself the machine is capable of measuring and obtaining the actual position of the track in space in real time. Through the software, it is able to compare this instant actual position with the theoretical final position previously introduced or defined, obtaining in real time the difference between both of them, and therefore the displacements needed to achieve the latter. Through the components of the control system these data of necessary displacement are processed and transmitted to the cylinders of the hydraulic system, which physically perform the required movements.

Since this whole process is in real time, the new position once initiated the movement is detected by the measuring system and processed by the software and the control system. The new data of required displacement, i.e. the new recalculated difference between the new actual position and the theoretical final position, is transmitted again to the hydraulic system. It is therefore a cyclical process in real time. This cyclical process begins once the machine has been placed in the track section to be positioned and it has fastened the rails through the fastening elements. At that moment the positioning cycle begins: the data capture occurs continuously, as well as its subsequent treatment, processing, transmission to the driving system and materialization of the movements, giving rise to a continuous feedback process—approaching the track gradually to its final theoretical position in each cycle— repeating until the track finally reaches the desired theoretical position within the required tolerances, point at which the process and the movement will be interrupted, thus considering finished the cyclical process, and therefore the positioning. It is therefore constituted a closed cycle of automatic control, the position of the track being, once the process begins, increasingly closer to the target final position until finally reaching this position, point at which the process is interrupted and therefore the movement.

Once the track is positioned in that section, the machine drops the rails opening the fastening devices, closes the lifting cylinders allowing for the weight of the machine to rest on the wheels, and moves to a new position, i.e., to a new section of the track, moving longitudinally on it. Once the new section is reached it must park, hold the rails through the fastening system and start again the automatic cyclic process of positioning of the track.

In the design of the machine it has been taken into account that it has to be robust as to handle the high weights of the rail-sleepers/blocks/fasteners assembly (preassembled track) and the own weight, holding the track by the two rails, but at the same time sufficiently precise to achieve tenths of a millimeter displacements in all its movements. Physically, the machine consists of a mobile metallic structure and a hydraulic and electrical system enabling the necessary physical movements. The machine has to be able to travel longitudinally along the track, preferably on railway wheels—it also could be lateral crawler tracks on the platform, on both sides of the track—both to access the track section to be positioned and to be removed from it.

The machine includes a measuring system that by combining the use of position sensors (inclination sensors, etc.) and robotic topographic stations (or other measuring devices such as GPS, etc.) allows the acquisition of the necessary position data of the track completely automatically and with the required extreme accuracy. This measuring system is formed on the one hand by sensors, located in the own machine, providing the relative position of the track in real time, and in turn receives data collected by a total station or other topography apparatus—preferably but not exclusively a standard robotic topographic station, or a GPS—, which provides the absolute position. The acquired data that identify the actual position of the track are transmitted by means of communication equipments to a PC wherein the software is installed, so that they can be processed.

The movements of the machine are governed by a control system which constitutes one of the essential parts for its automatic and autonomous functioning without human intervention. This control system is physically comprised of a PC and/or a PLC, or alternative equipment capable of providing this same functionality. This control unit includes a communications unit able to transmit instantly and fast enough, the data flow, processing them and transforming them into signals that are transmitted to the hydraulic system so that it can conduct the required physical movements. It also includes a software that allows to process the data of actual position acquired by the measuring system, comparing them with those of the theoretical final position previously defined or introduced, performing this operation multiple times per second and in real-time, obtaining as a result the output data, that identify the difference between the desired final position and the actual position in every moment, i.e., the movement that is necessary to be carried out by the mechanical and hydraulic system to achieve the final desired position.

The machine object of the invention provides a new methodology of leveling and alignment of ballastless track, fully automated, which allows completely automatically leveling and aligning the track, leaving it in its final position for its subsequent fixation and concreting. It is therefore an "integral mechanical system" that allows to position the track, aligning it and leveling it fully automatically and without human intervention from the random initial position to the exact theoretical final position, automatically and in a single step, verifying and validating the definitive position at the end of the movement. To this end it has been applied control engineering, using sensors to measure the results (output parameters) of the device that is being controlled and to use those measures to provide feedback to the actuators entries, which in turn carry out the position corrections towards the desired output.

DESCRIPTION OF THE FIGURES

To complement the description that is being carried out and with the object of facilitating the understanding of the features of the invention, the present specification is accompanied by a set of drawings wherein, with illustrative character and without limitation, the following has been represented.

PREFERRED EMBODIMENT OF THE INVENTION

Figure 1:
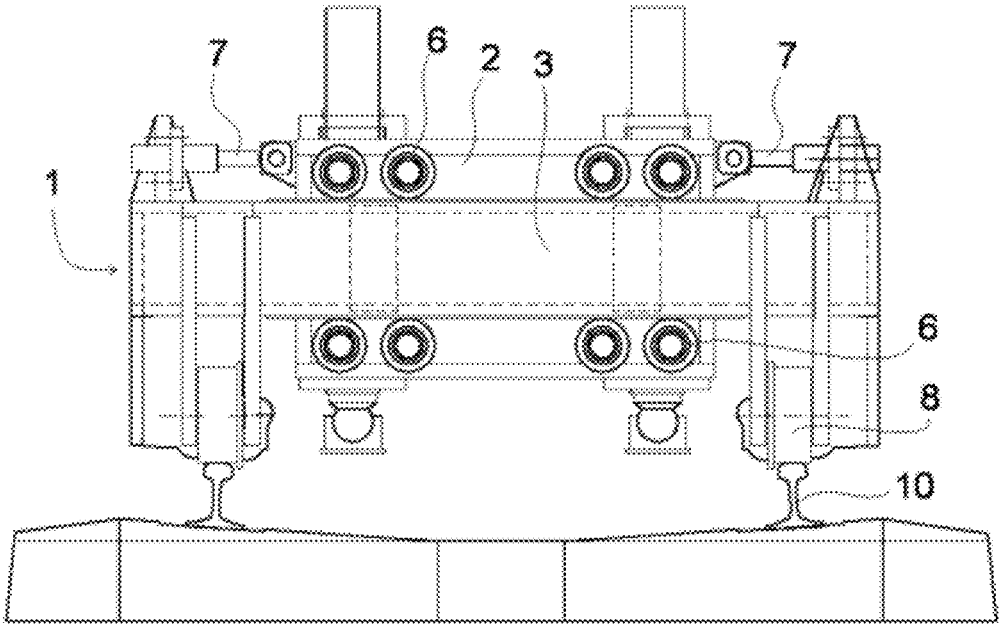
FIGS. 1 to 4 represent front elevational views of the machine of the invention at different stages, starting from an initial rest position or of forward movement on the track, to the operating leveling positions shown in FIGS. 3 and 4.
Figure 5:
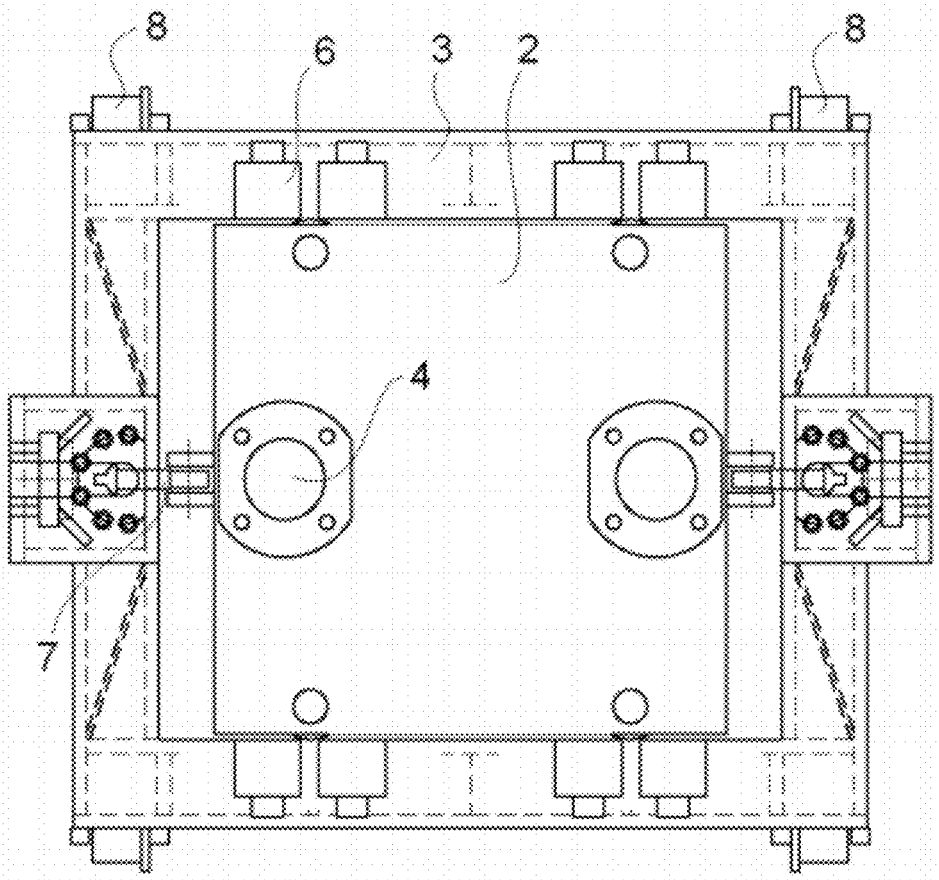
FIG. 5 is a plan view of the machine.
Figure 6:
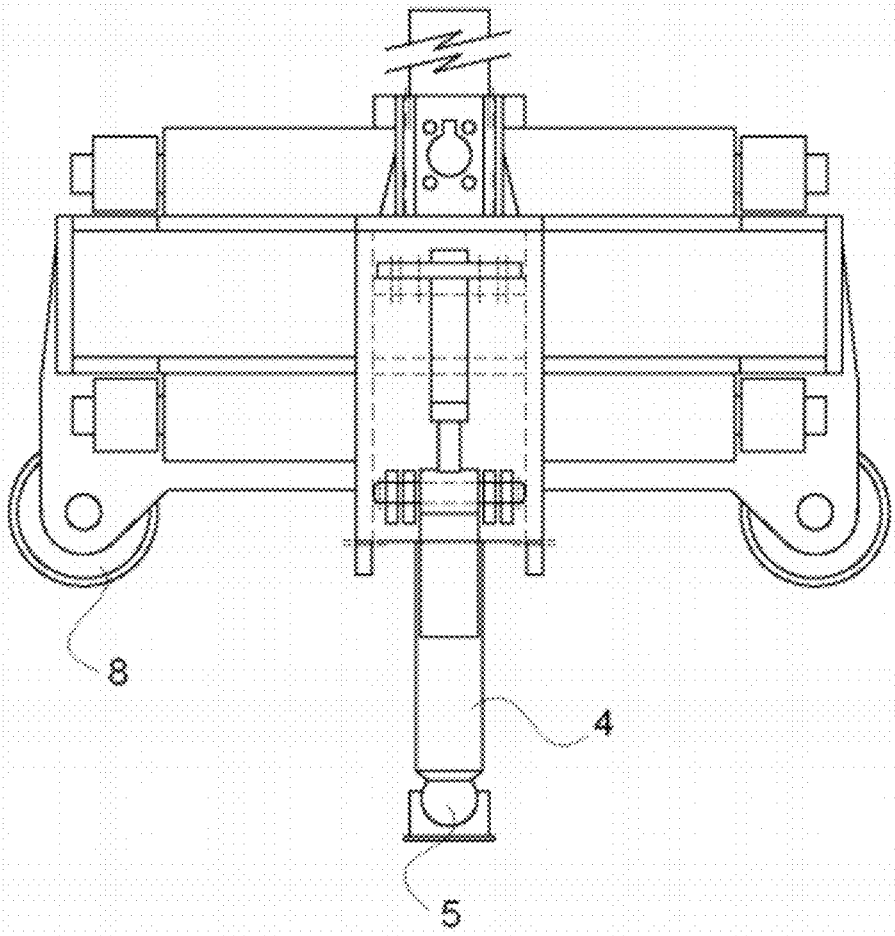
FIG. 6 is an elevational side view of the machine.
Figure 7:
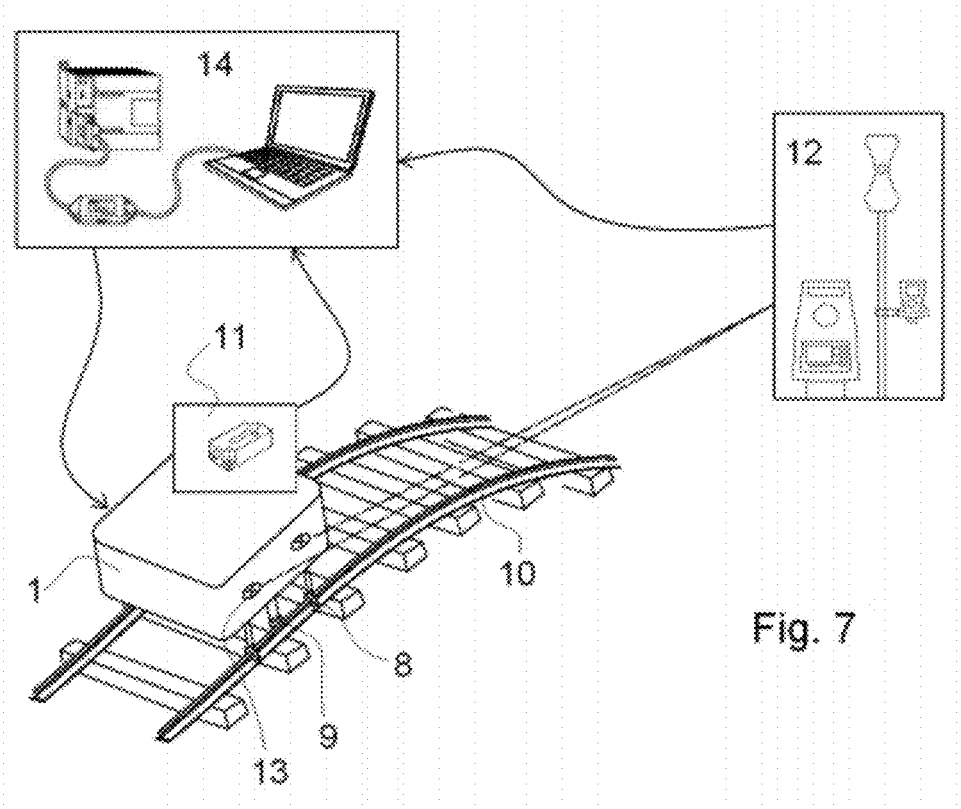
FIG. 7 represents a schematic view of the assembly of the machine, which includes the physical structure of the same (1), a series of sensors and a control unit.

The structure of the machine is clearly observed in FIGS. 1, 5 and 6. It is constituted by two differentiated structural bodies (2-3) and with relative movement between them:

The main body (2) consists of a metallic structure. It has fixed inside the two hydraulic lift cylinders (4), through which the weight of the assembly track-machine is transmitted to the ground. In addition, through the actuation of these two cylinders (4) which expand and compress independently, provides the appropriate height of both rails and the cant (height difference between the rails in a section perpendicular to the axis of the track) for the track—through the second body of the machine—, i.e. the height difference between the two rails within a given track section. The functioning of this body is comparable to that of a rigid structural portico with pillars of variable length.

Figure 4:
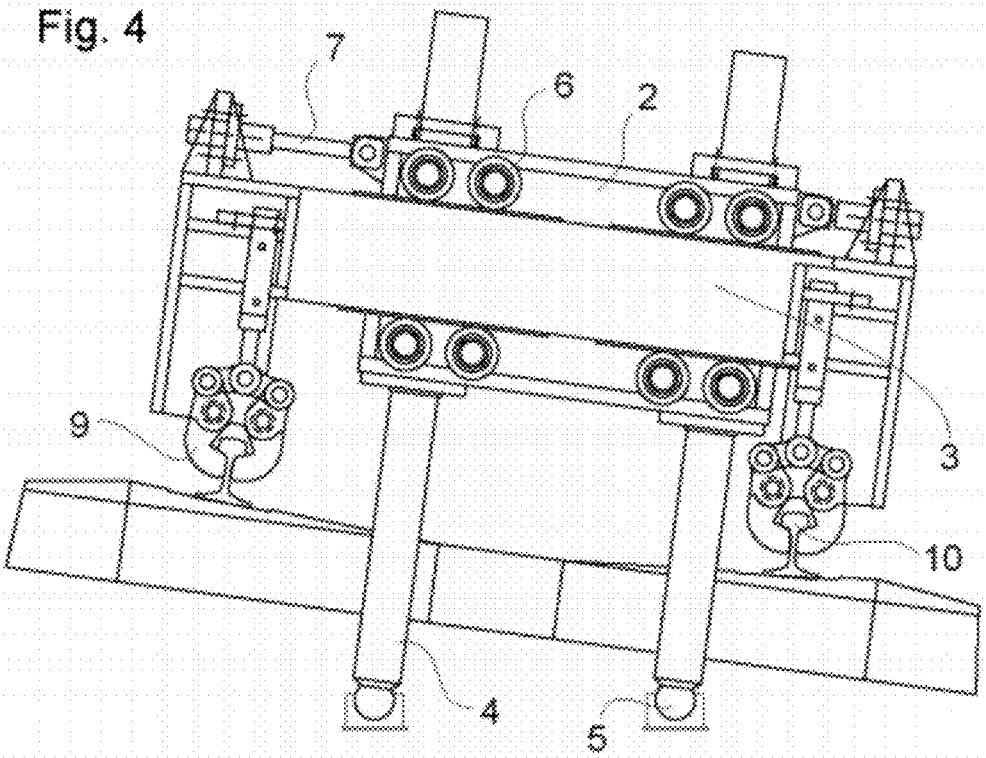

The bottom of the lift cylinders (4), in contact with the ground, has a spherical bearing (5) that allows the rotation of the body when one of the cylinders is opened more than the other to achieve a height difference in the rails. (See FIG. 4).

Laterally it has incorporated a roller assembly (6), located both at the top and at the bottom and both in the front and in the rear part. The function of these rollers is to allow the relative movement between this main body (2) and the secondary body (3), as well as to guide the latter on the first, forcing the movement of the second body (3) to be parallel and aligned with the main one (2), and therefore with the same angle with respect to the horizontal which thanks to the different opening of the two lift cylinders has acquired the surface of the main body.

The relative movement is achieved thanks to two hydraulic cylinders (7) which will be called "relaying", therefore fixed at their ends to both bodies (2-3). These cylinders (7) are located at the top of the main body (2) preferably though not exclusively, on both sides, and in perpendicular direction to the axis of the track, movement for which they are responsible, as explained.

The second body (3) consists of a metallic structure. It has on both sides two pairs of wheels (8), preferably track wheels, which will serve to enable the displacement of the machine on the track. These wheels (8) are motorized. In addition this secondary body (3) includes the fastening system of the rails, composed by two clamps (9), the function of which is to hold the two rails (10) of the track. These clamps (9) are operated through the hydraulic system by means of two cylinders. Once the clamps are closed, the rails (10) on that section of track are fixed to the secondary body (3) of the machine, and therefore they will move in an integral manner to it, allowing to position them both in height of each one of them and in cant in that section.

The closure of these fastening devices (9) of the rails is firm, i.e. it does not allow relative motion during the positioning, point at which all the load of the track is being suspended punctually on them.

Figure 2:
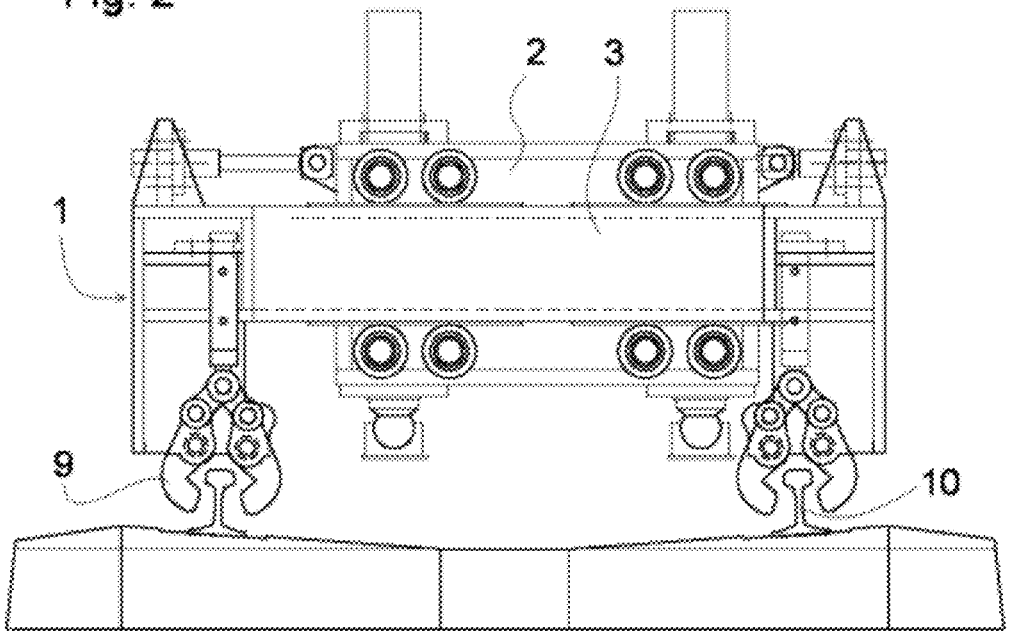
Figure 3:
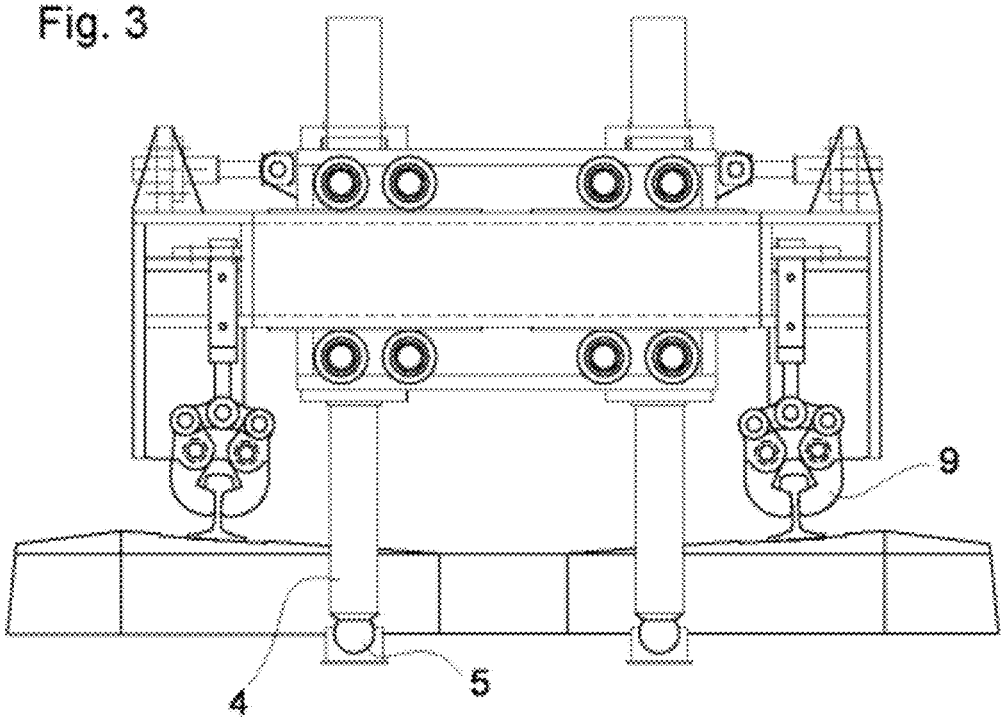

The position of the rails (10) and therefore of the track is achieved by the combination of a variation of the cant and the height (lift cylinders) on one side and a transverse movement, led by the relaying cylinders (7), on the other. This is carried out in the following way: once the machine is located in the track section to be positioned (see FIG. 1), the clamps (9) that make up the fastening device are closed on both rails (10) (see FIG. 2), the secondary body (3) and the track being integral thereafter. The oscillation of the main body around the rotation center (rotation center of one of the two ball bearings (5) in contact with the ground in the bottom of the lift cylinders) is achieved through the different opening of the lift cylinders (4). When it oscillates it behaves in the section to be positioned as a rigid portico, conferring the required cant to the horizontal part of the machine (i.e., to the upper horizontal member of the portico). The secondary body (3) aligned with that horizontal part of the main body (2) through the rollers (6), acquires at that time therefore that same cant, and therefore the track, which is integral to this secondary body (3) through the clamps of the fastening devices (9), also acquires it.

The crosswise movement is achieved by actuating the relaying cylinders (7), with the aligned relative displacement of the secondary body (3) (and therefore of the firmly fixed track) on the main body (2) through the rollers (6).

Once the track is positioned in that section through the combination of these movements, it proceeds to fix the same using conventional means, which are not an object of the present invention. Once fixed, the clamps (9) of the fastening system are opened and the lift cylinders (4) are closed or compressed, which allows the machine to completely rest its weight on the track wheels (8). It that moment it can move on the track to the new section to be positioned on these motorized wheels.

With the purpose of achieving all the described movements, the machine is equipped with a hydraulic system and an electrical system designed and sized for that purpose. The electrical system is also responsible for feeding the different measurement and control equipment.

The machine includes a measuring system, data acquisition system, sensors and topographic station (or GPS), which is a fundamental part of its operation. As indicated in the previous description it is necessary to simultaneously use two types of measuring devices and acquisition of position data, to determine the absolute and relative position of the machine at all times.

The first device (12) will allow us to know the absolute position of the system in space; it will be preferably but not exclusively a topographic total station. In addition it will be preferably a robotic station—this type of station is able to follow a moving prism automatically without human intervention—.

The prism (13) is placed in the own machine in a known, fixed and unchanging, calibrated position and perfectly referenced to the rail in its position of "actuated fastening system and clamps closed on the rail". Thus, in that situation, the position of the prism, which is identified by the total station, unequivocally identifies the absolute position of the rail, being able to deduce one from the other unequivocally.

The support system of the prism (13) can be configured by a small structure for the support of the prism and a lateral feeler in permanent contact with a point of the rail—preferably the active side—. Between the feeler-prism assembly and the own structure there is a spring-type element, gas spring or the like, which will always ensure the contact of the feeler-prism assembly with the active side of the rail. As a result the prism will have a position always fixed and known with respect to the active side of the rail, and therefore the position of the rail can be derived from the reading of the prism in an unequivocal manner.

Therefore, the total station (12), stationed properly according to the topographical procedures and in a position from which the machine and the prism are visible, continuously takes values from the absolute position of the prism. Once the machine is situated in the section to be positioned and the clamps are closed (the secondary body is integral at that time to the track)—point at which the positioning automatic cycle begins—the station takes the prism obtaining the coordinates of the absolute position of the same, from which the absolute coordinates of the rail can be derived, as described above.

Once the positioning automatic cycle has begun, when the movement of the hydraulics is produced, the track and the prism will move, the latter being followed by the robotic station which will provide at all times the instant position of the same in its movement. A GPS or other measurement equipment can be used to provide absolute coordinates rather than the total station.

The second device (11) is used to know the relative position of the track at all times, for which it is necessary to provide a series of relative measures. Tilt sensors are preferably used for this.

To measure the real cant of the track—height difference between both rails in the plane perpendicular to the axis of the track (positioning plane)—a tilt sensor placed in the exact alignment of the rails in this cross-section, or in a position of the machine unequivocally referenced to this alignment is used.

In the case of measuring the longitudinal tilt of the machine with respect to the horizontal, a tilt sensor will be used in the vertical plane of the machine containing the axis of the track in that positioning section. This sensor will be placed in a position parallel to the vertical surface of the machine and therefore of the fastening devices.

The machine also has to include an automatic control system (14), able to materialize the automatic positioning cycle of the track, controlling at all times all the movements of the machine, without human intervention, from the random initial position of the track to the desired theoretical position. For this, always working in real time, its functions are:

Receiving the data from all the data acquisition measuring devices (11-12) (total station or the like and tilt sensors or the like). These input data define the instant position of the track.

The control system (14) processes the data via a geometric mathematical model and associated software, obtaining after the treatment of the same the parameters of displacement of the points of the system in the three axes defined in space, and the movements to be performed by the hydraulic cylinders to obtain that position. Based on these data, the system generates suitable output signals that serve as input signals for the hydraulic system.

It must transmit the generated signals to the hydraulic system, such that the physical actuators can carry out the required displacements towards the desired theoretical position.

Always in real time, it must receive again the data from the data acquisition devices corresponding to the new positions, synchronize them and adjust them so that they can be processed again.

It is an automatic cyclic process in real time, in which the data capture occurs continuously, as well as its subsequent treatment, processing, transmission to the driving system and materialization of the movements, giving rise to a continuous feedback process that will be repeated until all the points of the system achieve the desired theoretical position within the required tolerances.

Figure 8:
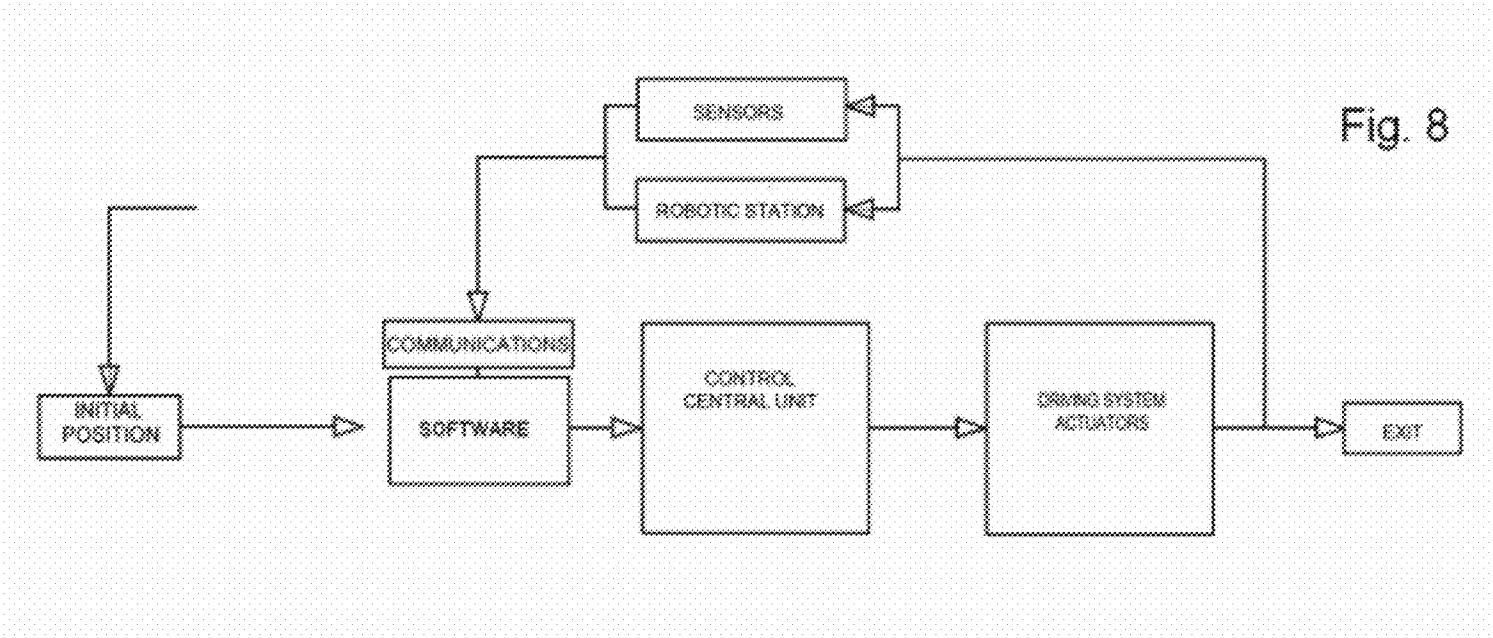
FIG. 8 shows a block diagram of the operation of the control system of the machine.

The calculation software together with the control system allows calculating all the movements needed in space to reach the target position, and performing them in any desired order, or all of them simultaneously, this being specified in the software or in a programmable automaton (PLC). The movement is therefore a global movement towards the target, decomposed into the different movements of the hydraulic. Manually and sequentially actuating the hydraulics would not allow to properly directly reach the target position since some movements would affect the others: i.e. an angle variation would affect the height of the rails, as well as a relaying movement, etc. The scheme of the control system is shown in FIG. 8.

The control system includes a communications mechanism with:

The robotic station (12) communicates preferably through radio with the processor and the data processing software located in the machine. The station sends on an ongoing basis the data of the absolute coordinates of the track, reading for this purpose the prism located and referenced in the machine.

The sensors (11) also communicate with the processor. By being both of them placed in the machine, the communication can be done by cable or through radio or another mean (Bluetooth, etc. . . . ) continuously sending the measurement data of the inclinations of the system in the different axes.

The software receives input data, on the one hand, data concerning the actual position of the track at a given moment: coordinates and angles provided by the measuring system (total station and tilt sensors). On the other hand, the data concerning the theoretical geometry of the track. These data may have been previously entered before the beginning of the work through the theoretical tracing. This final theoretical position of the track can be introduced in the form of the axes (planimetry and altimetry) and the cants in each section, or in any other manner and in any format. To know the point of the track where it is at that time and obtaining from the axes or listings entered the theoretical position required at that point, the software uses the position provided by the measuring system.

An interesting feature for this software is its compatibility with any other existing tracing software system to be able to import the theoretical target data.

The function of the software is to compare both blocks of input data, i.e. to compare the actual position as measured by the data acquisition system with the theoretical target position, materializing the necessary calculations to obtain as output data the required displacements of the track for achieving the desired final position, and the required displacements for this of every cylinder of the hydraulic system (this last can be obtained either directly by the software in the PC or through a transformation in the PLC itself from the data of the required displacements for the track)

The software is configured in such a way that it enables the communication with all kinds of hardware—sensors, total stations, etc.

The physical support of the software will be a processor, a special or conventional PC or the like preferably located in the machine, although it can also be located or transported outside the same.

These output data obtained by the software are transmitted to a programmable automaton (PLC), which is in charge of processing them and generating the signals to be transmitted to the hydraulic system.

With regard to these physical supports, they can be configured in different ways: the PC and the PLC can be independent, as described here, or alternative equipment capable of providing this same described functionality could be used. Also the data processing completely included in the software according to the description made, could be completely carried out in the own PLC, or in alternative equipment in a flexible manner always fulfilling the described functionality.

Once sufficiently described the nature of the invention, as well as an example of preferred embodiment, herewith it is stated to the appropriate effects that the materials, shape, size and arrangement of the elements described above may be modified, provided this does not involve an alteration of essential features of the invention claimed below:

The invention claimed is:

1. A machine for leveling and alignment of a section of ballastless railway track having two rails joined through fasteners to connecting elements, comprising:

a structure comprising a main body and a secondary body coupled to the main body and movable laterally relative to the main body, the main body comprising a plurality of lift cylinders for lifting the structure, having an upper end connected to the main body and a bottom for contacting the ground;

the secondary body comprising a plurality of wheels for movement of the structure along a track, two fastening elements to firmly grab each of the two rails, once situated in the section, for lifting and suspending the rails and connecting elements that make up the track, a plurality of relaying hydraulic cylinders coupled to the main body and the secondary body, for lateral movement of the secondary body relative to the main body, such that when the main body is raised by the plurality of lift cylinders, the rails and connecting elements are suspended, the secondary body is moved laterally by the plurality of relaying hydraulic cylinders, displacing the track, leveling and aligning the track; and when the main body is lowered by the plurality of lift cylinders, the rails and connecting elements are placed in a desired final position;

a measuring system, comprising a plurality of tilt sensors for sensing a relative position of the track in real-time, and a total station for acquiring data relating to absolute position of the track, such that an actual position of the track is determined in real time;

a control system comprising a processor having software for processing position of the track acquired by the tilt sensor and the total station, comparing the actual position of the track with a desired final track position, obtaining as a result the difference between the desired final track position and the actual track position, and determining the lateral movement of the secondary body on the main body needed to achieve the desired final track position, such that the processor controls the hydraulic lift cylinders and the relaying hydraulic cylinders such that the machine carries out the required movements.

2. The machine of claim 1, in which:

the lift cylinders are independently controlled so as to adjust height of each rail independently, thereby adjusting a cant of the track in the section;

the lift cylinders further comprise a spherical bearing (5) at the bottom for allowing rotation of the bottom of the cylinder when in contact with the ground, so that when a lift cylinder expands more than another lift cylinder, the main body tilts, thus conferring the cant to the track in a specific section of the same.

3. The machine of claim 1, in which the total station determines an absolute position of the system in space, comprising a robotic topographic total station able to automatically follow a moving prism located on the machine itself in a known and unchanging position, the total station being calibrated to the rail when it is fastened by the fastening elements of the secondary body, so that the position of the prism identifies the absolute position of the rail or the track.

4. The machine of claim 3 further comprising equipment in communication with the robotic topographic total station that continuously send the data of the absolute position of the track, reading for this purpose the prism located on the machine, and with the tilt sensors located in the machine, which continuously communicate the measurement data of inclinations of the system in different axes.

5. The machine of claim 3, in which the prism is located on a lateral feeler in permanent contact with a point of the rail, such that the prism will have a fixed and known position with respect to the rail, and the robotic topographical total station can determine the position of the rail from the reading of the prism.

6. The machine of claim 1, in which the total station is of topographic or GPS type.

7. The machine of claim 1, in which the secondary body is coupled to the main body by a roller assembly, allowing the movement of the secondary body parallel to and aligned with the main body, such that the angle from horizontal of both the main body and the secondary body is defined by extension of the lift cylinders.

8. The machine of claim 1, in which the secondary body comprises two pairs of wheels to allow the displacement of the machine on the track.

9. The machine of claim 1, in which the wheels are motorized.

10. The machine of claim 1, in which the tilt sensors comprise sensors located on the machine for sensing tilt in a direction across the track, for determining the cant of the track.

11. The machine of claim 1, in which the tilt sensors comprise sensors placed on the machine for sensing tilt longitudinally along the track in the vertical plane of the machine, to determine a slope of the track.

* * * * *